United States Patent [19]

Bar

[11] Patent Number: 4,582,468

[45] Date of Patent: Apr. 15, 1986

[54] SUCTION MUFFLER FOR HERMETIC MOTOR COMPRESSORS HAVING M-SHAPED OIL SEPARATION ELEMENT

[75] Inventor: Alfredo Bar, Pavia, Italy

[73] Assignee: Necchi Societa per Azioni, Pavia, Italy

[21] Appl. No.: 677,239

[22] Filed: Dec. 3, 1984

[30] Foreign Application Priority Data

Dec. 12, 1983 [IT] Italy ..... 42922 A/83

[51] Int. Cl.[4] ..... F04B 39/00

[52] U.S. Cl. ..... 417/312; 417/313; 417/415; 417/902; 92/79; 181/403; 55/276; 55/465; 62/296

[58] Field of Search ..... 417/312, 313, 415, 902; 92/79; 62/296; 181/403; 55/276, 465

[56] References Cited

U.S. PATENT DOCUMENTS

| | | | |
|---|---|---|---|
| 612,226 | 10/1898 | Bailey | 417/273 |
| 2,005,959 | 6/1935 | Smith | 92/79 X |
| 2,133,875 | 10/1938 | Steenstrup | 417/312 |
| 2,157,829 | 5/1939 | Metzgar | 55/465 |
| 2,301,656 | 11/1942 | Hirche | 92/79 |
| 4,313,715 | 2/1982 | Richardson, Jr. | 417/312 |
| 4,370,104 | 1/1983 | Nelson et al. | 417/312 |
| 4,401,418 | 8/1983 | Fritchman | 417/312 |
| 4,415,060 | 11/1983 | Bar | 417/312 |

FOREIGN PATENT DOCUMENTS

| | | | |
|---|---|---|---|
| 96378 | 7/1980 | Japan | 417/415 |
| 913030 | 12/1962 | United Kingdom | 62/296 |

*Primary Examiner*—William L. Freeh
*Assistant Examiner*—Paul F. Neils
*Attorney, Agent, or Firm*—Stevens, Davis, Miller & Mosher

[57] ABSTRACT

A muffler for motor compressors comprising a body closed at the lower side by a cover and provided on its frontal wall with a hole through which the refrigerating gas is sucked. The gas introduced into the interior of the body strikes against the rear wall of the body and is diverted toward two narrow passages formed by the lateral internal walls of the body and by vertical walls of an M-shaped element located internally of the body. The inclined walls of the element favor the collection of the oil which has separated from the refrigerating gas and directs it toward an inclined plane which facilitates the discharge of the oil, by gravity, through a groove made in the body of the muffler.

2 Claims, 3 Drawing Figures

SUCTION MUFFLER FOR HERMETIC MOTOR COMPRESSORS HAVING M-SHAPED OIL SEPARATION ELEMENT

DISCLOSURE OF THE INVENTION

The present invention relates to a muffler for motor compressors which comprise an electrical driving motor, a cylinder and a cylinder head having suction and discharge chambers for the refrigerating gas.

In planning a muffler for the discharge line of a herimetic refrigeration compressor, it is necessary not only to take into account noiselessness but also the reduction of the overheating phenomenon, the gas load lost and separation of the oil particles, dragged by the gas. The separation of the oil from the refrigerating gas is important for two different reasons. The first reason regards the normal working of the motor compressor and is relative to the fact that, in the case of that the oil does not separate, the flowing refrigerating gas tends progressively to increase its contents of oil and this causes a loss in efficiency of the refrigeration cycle, due to the fact that a portion of the discharge energy is transferred to the oil and moreover the oil, because of its thermic capacity absorbs part of the evaporation heat and makes lower the heat transmission coefficient at the walls of the heat exchanger. The loss in efficiency increases as the delivery of oil becomes greater in a weight percentage by comparison with the refrigerating gas. The second reason has regards to the possible accumulating of quantities of oil, equal about to the cubic capacity of the compressor, which for any reason may be in the refrigerating circuit (e.g., due to the transport of the refrigerator).

In this case the separation of the oil from the refrigerating gas is important in order to avoid the damage of the compressor caused by the suction of a non-compressible fluid.

Therefore, it is an object of the present invention to provide a muffler to overcome the above-described drawbacks.

The technical problem to be solved was that of developing a muffler with a particular structure such as to permit the separation of the oil from the refrigerating gas.

The solution of the technical problem was found in a muffler formed by a body closed at the lower side by a cover and provided on its frontal wall with a hole through which the refrigerating gas is sucked, an M-shaped element provided internally of said body to separate the refrigerating gas from the oil particles contained therein, and a conduit by which to discharge the separated oil.

Other details and features of the invention will stand out from the description given below by way of non-limitative example and with reference to the accompanying drawings, in which.

Figure 1:
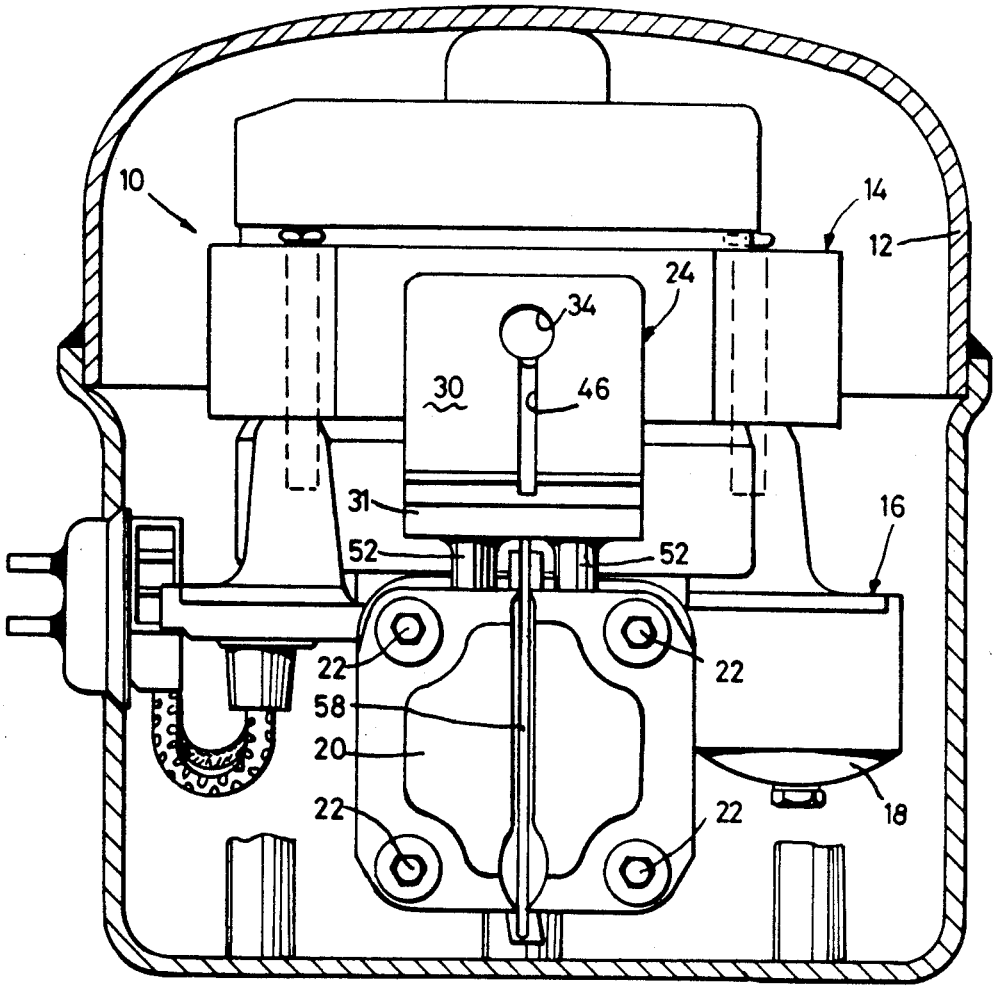
FIG. 1 shows a vertical internal view of the compressor.

With reference to FIG. 1, there is shown a motor compressor assembly 10 hermetically closed inside the casing 12, in which the refrigerating gas is contained. The motor compressor 10 includes an electric motor 14, a cylinder block 16, a muffler 18 on the discharge line, formed by casting with the cylinder block 16. A cylinder head 20 is connected by bolts 22 with the cylinder not shown in the drawings. On the cylinder head 20 is connected the muffler 24 which forms the object of the present invention.

Figure 2:
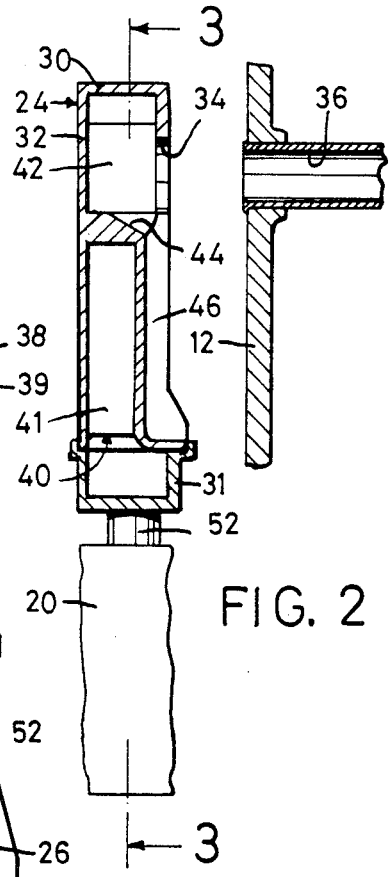
FIG. 2 is a lateral side view of the muffler of the present invention.
Figure 3:
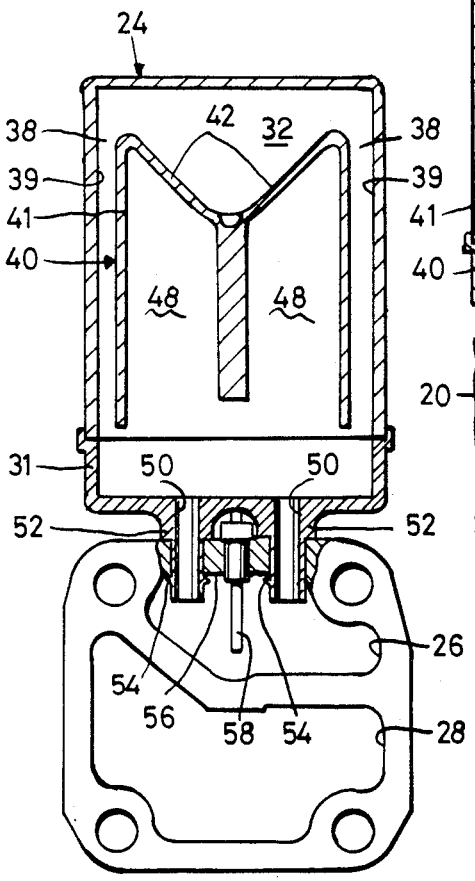
FIG. 3 is a cross-sectional view taken on line 3—3 of FIG. 2.

FIGS. 2 and 3 show in detail the structure of the muffler connected to the suction chamber 26 formed, in the cylinder head 20. Discharge chamber 28 also is shown in cylinder head 20. The muffler 24 is formed by a body 30 and a cover 31 which closes said body 30 in its lower side. On its frontal side, the body 30 defines a hole 34 (FIGS. 1 and 2) which is axially aligned with the little tube 36 of the suction line which carries the refrigerating gas from the vaporizer into the casing 12. The sucked refrigerating gas strikes against the rear wall 32 and is diverted toward two narrow passages 38 formed by the lateral internal walls 39 of the body 30 and by the vertical walls 41 of an M-shaped element 40 located internally of said body 30. By this diversion of the flow, a separation of the oil particles from the refrigerating gas is obtained. The inclined walls 42 of the element 40 favor the collection of the oil before the suction phase and direct it toward an inclined plane 44 which facilitates the discharge of the oil, by the gravity, through a groove 46 made on the frontal wall of the body 30, onto the bottom of the casing 12.

The refrigerating gas, after the separation of the oil particles, passes through the narrow passage 38 and arrives in two expansion chambers 48. From expansion chambers 48, the refrigerating gas passes through two holes 50, on the bottom wall of the cover 31, to the suction chamber 26 by means of two little pipes 52 formed by the body 30.

The lower portions of the pipes 52 are forced into corresponding holes made on the upper portion of the cylinder head. The use of the two pipes prevents rotation of the muffler about its vertical symmetrical axis, due to the vibratons of the motor compressor. The muffler's disconnection from the cylinder head is prevented by providing the two pipes 52 with rings 54 positioned on the external circumference of the pipes in contact with the wall 56 of the cylinder head 20.

In FIGS. 1 and 3, a capillary pipe 58 is indicated which, according to a known technique, supplies small quantities of lubricant, sucked from within the casing 12, to the system of the valves provided in the cylinder head and not shown in the figures.

I claim:

1. A suction muffler for a motor compressor, said compressor comprising a hermetic sealed casing, a driving electric motor, a cylinder and a cylinder head accessing the suction and discharge chambers of the refrigerating gas within said casing, said suction muffler comprising a body having top rear and frontal walls, a pair of lateral walls and a cover closing a lower side of the body, said cover having holes therein communicating with said suction chamber, said body providing on its frontal wall a hole through which the refrigerating gas is sucked, first means positioned internally of said body to separate said refrigerating gas from the oil particles contained therein, and second means to discharge said separated oil from said body, said first means being formed by a M-shaped element adapted to create narrow passages with the lateral walls of said body in such a way that the sucked refrigerating gas strikes against the rear wall of said body and is diverted toward said narrow passages for obtaining the separation of the oil particles from the refrigerating gas.

2. The muffler of claim 1, wherein said second means are formed by inclined walls of said M-shaped element which collect the oil separated from the refrigerating gas and direct it toward an inclined plane formed at the juncture of said inclined walls and which discharges the oil, by gravity, through a groove formed on the frontal wall of said body.

* * * * *